US008025354B2

(12) United States Patent
Baker et al.

(10) Patent No.: US 8,025,354 B2
(45) Date of Patent: Sep. 27, 2011

(54) SENSING OBJECTS FOR PRINTING

(75) Inventors: Richard J. Baker, West Lebanon, NH (US); William Leathers, Quechee, VT (US); Bailey Smith, Bow, NH (US); Roger Therrien, Hanover, MA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 156 days.

(21) Appl. No.: 12/478,678

(22) Filed: Jun. 4, 2009

(65) Prior Publication Data

US 2009/0303266 A1 Dec. 10, 2009

Related U.S. Application Data

(60) Provisional application No. 61/059,705, filed on Jun. 6, 2008.

(51) Int. Cl.
*B41J 29/38* (2006.01)
*B41J 3/00* (2006.01)
*B41J 29/393* (2006.01)

(52) U.S. Cl. ..... 347/14; 347/4; 347/5; 347/19

(58) Field of Classification Search ..... 347/4, 5, 347/14, 19
See application file for complete search history.

(56) References Cited

U.S. PATENT DOCUMENTS 5,408,590 A 4/1995 Dvorzsak
5,576,744 A 11/1996 Niikura et al.
5,668,579 A 9/1997 Fujii et al.
5,784,171 A 7/1998 Kano
5,959,643 A 9/1999 Temple et al.
5,975,672 A 11/1999 Wen
5,988,784 A 11/1999 Takemura et al.
5,997,124 A 12/1999 Capps et al.
6,046,822 A 4/2000 Wen et al.
6,257,689 B1 7/2001 Yonekubo
6,295,077 B1 9/2001 Suzuki
6,312,076 B1 11/2001 Taki et al.
6,402,282 B1 6/2002 Webb
6,422,690 B1 7/2002 Harvey et al.
6,460,991 B1 10/2002 Temple et al.
(Continued)

FOREIGN PATENT DOCUMENTS

EP 1 452 313 9/2002
(Continued)

OTHER PUBLICATIONS

International Search Report and Written Opinion dated Jan. 13, 2010 issued in equivalent PCT Application No. PCT/US2009/046098, 11 pages.

*Primary Examiner* — Matthew Luu
*Assistant Examiner* — Jannelle M Lebron
(74) *Attorney, Agent, or Firm* — Fish & Richardson P.C.

(57) ABSTRACT

A printing apparatus including a conveyor capable of moving an object in a process direction, a drop ejection device, a sensor array that substantially spans the conveyor in a cross-process direction that is perpendicular to the process direction, the sensor array being configured to detect a position of the object in the process direction and cross-process direction, and a controller configured to receive position data about the object from the sensor array and to cause the drop ejection device to deposit fluid droplets on the object based on the position of the object on the conveyor.

28 Claims, 8 Drawing Sheets

U.S. PATENT DOCUMENTS

| | | | | |
|---|---|---|---|---|
| 6,471,315 | B1 | 10/2002 | Kurata | |
| 6,666,537 | B1 | 12/2003 | Kelley et al. | |
| 6,685,297 | B2 | 2/2004 | Butterfield et al. | |
| 7,360,853 | B2 | 4/2008 | Barss | |
| 2002/0196298 | A1 | 12/2002 | Cheng et al. | |
| 2004/0026212 | A1 * | 2/2004 | Maingonnat et al. | 198/459.5 |
| 2004/0028830 | A1 | 2/2004 | Bauer | |
| 2004/0070791 | A1 | 4/2004 | Pattusamy et al. | |
| 2006/0050099 | A1 | 3/2006 | Murakami et al. | |
| 2006/0082811 | A1 | 4/2006 | Gardner et al. | |
| 2006/0082812 | A1 | 4/2006 | Gardner et al. | |
| 2006/0082813 | A1 | 4/2006 | Martin et al. | |
| 2006/0082814 | A1 | 4/2006 | Gardner | |
| 2006/0092437 | A1 | 5/2006 | Martin | |
| 2007/0236528 | A1 * | 10/2007 | Oike | 347/19 |
| 2007/0236535 | A1 | 10/2007 | Baker et al. | |
| 2007/0247505 | A1 | 10/2007 | Isowa et al. | |
| 2008/0158279 | A1 | 7/2008 | Barss | |

FOREIGN PATENT DOCUMENTS

| | | |
|---|---|---|
| EP | 1 503 326 | 2/2005 |
| EP | 1 732 765 | 12/2006 |
| JP | 58055253 | 4/1983 |
| JP | 03065069 | 3/1991 |
| JP | 09123435 | 5/1997 |
| JP | 2001010035 | 1/2001 |
| WO | WO 01/12444 | 2/2001 |
| WO | WO 01/13328 | 2/2001 |
| WO | WO 2005/086715 | 9/2005 |

* cited by examiner

716

718

| | | |
|---|---|---|
| Pattern Data Scan line "N" | '100010001000....10001000' | |
| Virtual Image Scan line "N" | '000011111000....11111000' | And Function |
| Result line "N" | '000010001000....10001000' | |

720

SENSING OBJECTS FOR PRINTING

This application claims the benefit of U.S. Provisional Application No. 61/059,705, filed Jun. 6, 2008, and incorporated herein by reference.

BACKGROUND

Ink jet printers are one type of apparatus for depositing drops on a substrate. Ink jet printers typically include an ink path from an ink supply to a nozzle path. The nozzle path terminates in a nozzle opening from which ink drops are ejected. Ink drop ejection is typically controlled by pressurizing ink in the ink path with an actuator, which may be, for example, a piezoelectric deflector, a thermal bubble jet generator, or an electrostatically deflected element. A typical print assembly has an array of ink paths with corresponding nozzle openings and associated actuators. Drop ejection from each nozzle opening can be independently controlled. In a drop-on-demand print assembly, each actuator is fired to selectively eject a drop at a specific pixel location of an image as the print assembly and a printing substrate are moved relative to one another. In high performance print assemblies, the nozzle openings typically have a diameter of 50 microns or less, e.g. around 25 microns, are separated at a pitch of 100-300 nozzles/inch.

A piezoelectric actuator has a layer of piezoelectric material, which changes geometry, or bends, in response to an applied voltage. The bending of the piezoelectric layer pressurizes ink in a pumping chamber located along the ink path. Piezoelectric ink-jet print assemblies are also described in Fishbeck et al U.S. Pat. No. 4,825,227, Hine U.S. Pat. No. 4,937,598, Moynihan et al. U.S. Pat. No. 5,659,346 and Hoisington U.S. Pat. No. 5,757,391, the entire contents of which are hereby incorporated by reference.

SUMMARY

In one aspect, a printing apparatus including a conveyor capable of moving an object in a process direction, a drop ejection device, a sensor array that substantially spans the conveyor in a cross-process direction that is perpendicular to the process direction, the sensor array being configured to detect a position of the object in the process direction and cross-process direction, and a controller configured to receive position data about the object from the sensor array and to cause the drop ejection device to deposit fluid droplets on the object based on the position of the object on the conveyor.

This and other embodiments can optionally include one or more of the following features. The sensor array can be configured to detect more than one object at a time. The controller can be configured to cause the drop ejection device to deposit fluid droplets on more than one object at a time. The sensor array can be configured to detect a leading edge.

The controller can be configured to combine the position data with image data to create print data that is sent to the drop ejection device. The position data and image data can comprise a plurality of scan lines comprising binary data including 1s and 0s, 1 for active and 0 for inactive, and the controller can be configured to combine the position data and image data using an AND function. The apparatus can further include a memory that receives the print data from the controller and sends the print data to the drop ejection device. The apparatus can further include an image database for storing at least one image data that is sent to the controller.

The controller can include software configured to determine a center of the object based on the position data and to add the print data to the memory based on the center of the object. The controller can include software configured to determine an angle of the object and to adjust the image data to correspond to the angle of the object.

The apparatus can further include a delay mechanism that delays the drop ejection from depositing fluid droplets until the object has traveled from the sensor to the drop ejection device. The drop ejection device can include a plurality of jetting arrays. Each jetting array can include a plurality of modules, each module is configured to deposit a different color ink. The delay mechanism can delay the drop ejection device from depositing ink from each module until the object has reach that module.

The sensor array can be a charge coupled device camera. The sensor array can have a resolution that matches a resolution of the drop ejection device. The resolution of the drop eject device can be 100 dpi. The sensor can be stationary relative to the conveyor. The drop ejection device can be stationary relative to the conveyor.

In one aspect, an object is moved on a conveyer belt in a process direction, a position of the object in the process direction and cross-process direction, which is perpendicular to the process direction, is detected using a sensor array that substantially spans the conveyor in the cross-process direction, and a drop ejection device is caused to deposit fluid droplets on the object based on the position of the object on the conveyor.

This and other embodiments can optionally include one or more of the following features. The position of the object can be detected by a charged coupled device camera. A resolution of the camera can be matched to a resolution of the drop ejection device.

The drop ejection device can be delayed from depositing droplets until the object has reached the drop ejection device. The sensor array can be stationary relative to the conveyor. The drop ejection device can be stationary relative to the conveyor. Position data can be sent to a controller, the position data can be combined with the image data to create print data, and the print data can be sent to the drop ejection device. Further, the print data can be sent to a memory before being sent to the drop ejection device.

In one aspect, a printing apparatus includes a conveyor divided into a plurality of lanes for moving objects relative to a drop ejection device, a plurality of sensors including at least one sensor for each lane, the sensors configured to detect a leading edge of an object, a controller configured to receive signals from the plurality of sensors when objects are detected, the controller configured to determine the lane that corresponds to the signal and to send image data to that lane, a memory for receiving image data from the controller, the memory configured to enter the image data into the memory corresponding to the lane and to send the image data to the drop ejection device to deposit fluid droplets on the object moving through the corresponding lane.

In one aspect, a plurality of objects are moved on a conveyor belt having a plurality of lanes, an object moving through one of the plurality of lanes is detected using a sensor, after detecting the object, a virtual representation of the object moving on the conveyor is created, and the fluid droplets are deposited on the object in that lane.

Potential advantages of the invention may include none, one, or more of the following. A printing apparatus capable of printing on objects randomly placed on a conveyor without aligning the objects in lanes. The apparatus does not require lanes to separate rows of objects traveling on a conveyor, which can eliminate the need for expensive registration and alignment equipment. Further, since the objects are not aligned, they do not need to be touched, therefore, the apparatus can print on objects in a deformable state (e.g., wet, soft, uncured, or uncooked), such as cookies prior to baking or cupcakes covered in wet icing.

By using a camera to map the locations (e.g., X and Y coordinates) of a plurality of objects on the conveyor, a single datapath can be used rather than multiple datapaths, which can reduce the hardware complexity and cost of the system because less space and power are required. The images can be nested together using an OR function, such that objects on the conveyor can overlap without blocking a portion of an image. The OR function can also be used to print a background pattern on an object. The printing apparatus can print on symmetrical objects that do not have a specific orientation or it can print on asymmetrical objects by detecting the angular orientation of an object and rotating the image to align with the angle of the object.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
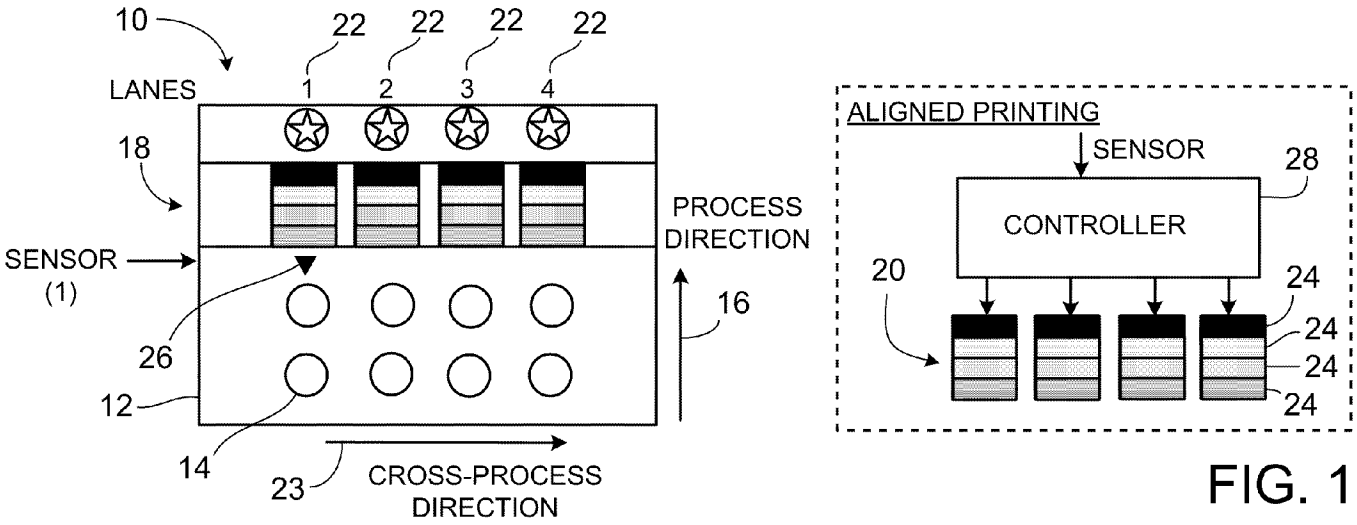
FIG. 1 is a schematic of a printing system with a plurality of lanes and a sensor.

Referring to FIG. 1, a printing system 10 includes a conveyor 12 for moving a plurality of objects 14 in a process direction 16 (e.g., Y-direction) to a drop ejection device 18. The drop ejection device can include a plurality of jetting arrays 20 for depositing fluid droplets on the objects. For example, the conveyor could be divided into a plurality of lanes 22 with a jetting array for each lane. Furthermore, each jetting array can include a plurality of modules 24, such as four modules for each lane (e.g., one module for each ink color, CMYK).

In FIG. 1, the objects in each lane are aligned in the process direction 16 and the cross-process direction 23 (e.g., X-direction, perpendicular to the process direction). Therefore, only one sensor 26 is needed to cause the drop ejection device to deposit fluid droplets on all four objects. The sensor can detect an object by sensing a leading edge of the object. When the sensor detects an object, the sensor can send a signal to a single controller 28 (e.g., a computer), and the controller sends print data to each of the jetting arrays for each lane.

Figure 2:
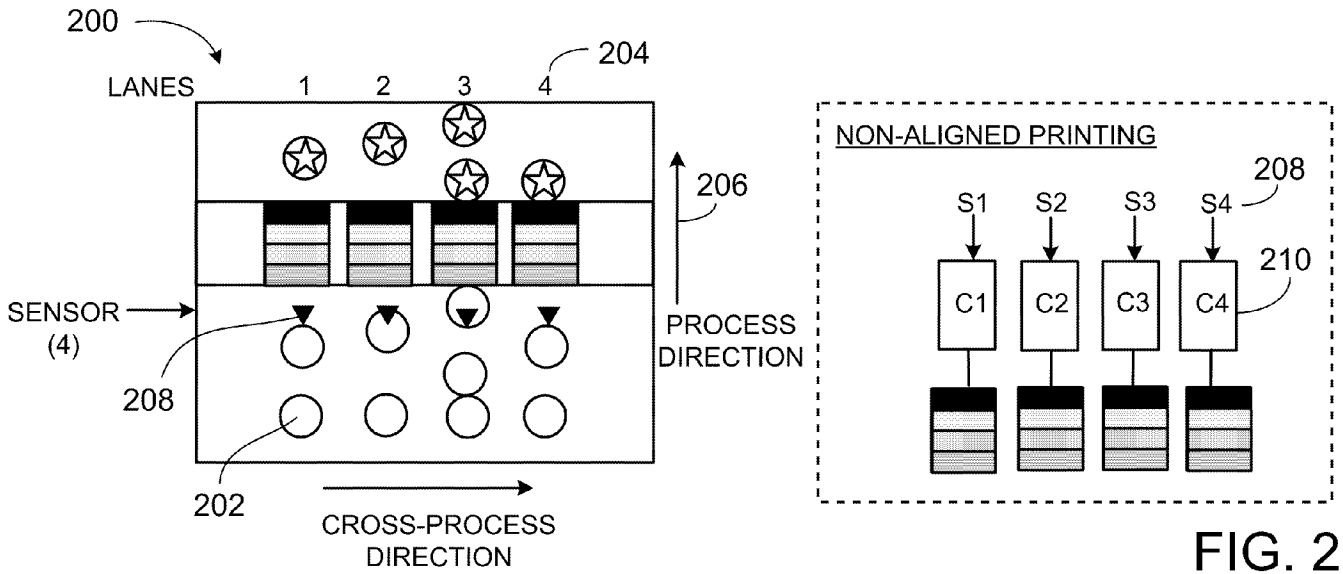
FIG. 2 is a schematic of a printing system with a plurality of lanes, a plurality of sensors, and a plurality of controllers.

Rather than being aligned in both the process and cross-process directions, the objects could be aligned only in the cross-process direction. FIG. 2 shows a printing apparatus 200 including objects 202 that are divided into lanes 204, but randomly placed in the process direction 206. Since the objects in each lane are not aligned with the objects in neighboring lanes, a sensor 208 is needed for each lane. Each lane now has a sensor 208 (S1, S2, S3, and S4) and a controller 210 (C1, C2, C3, and C4). This can add hardware complexity and cost because the system requires more space and power.

Figure 3:
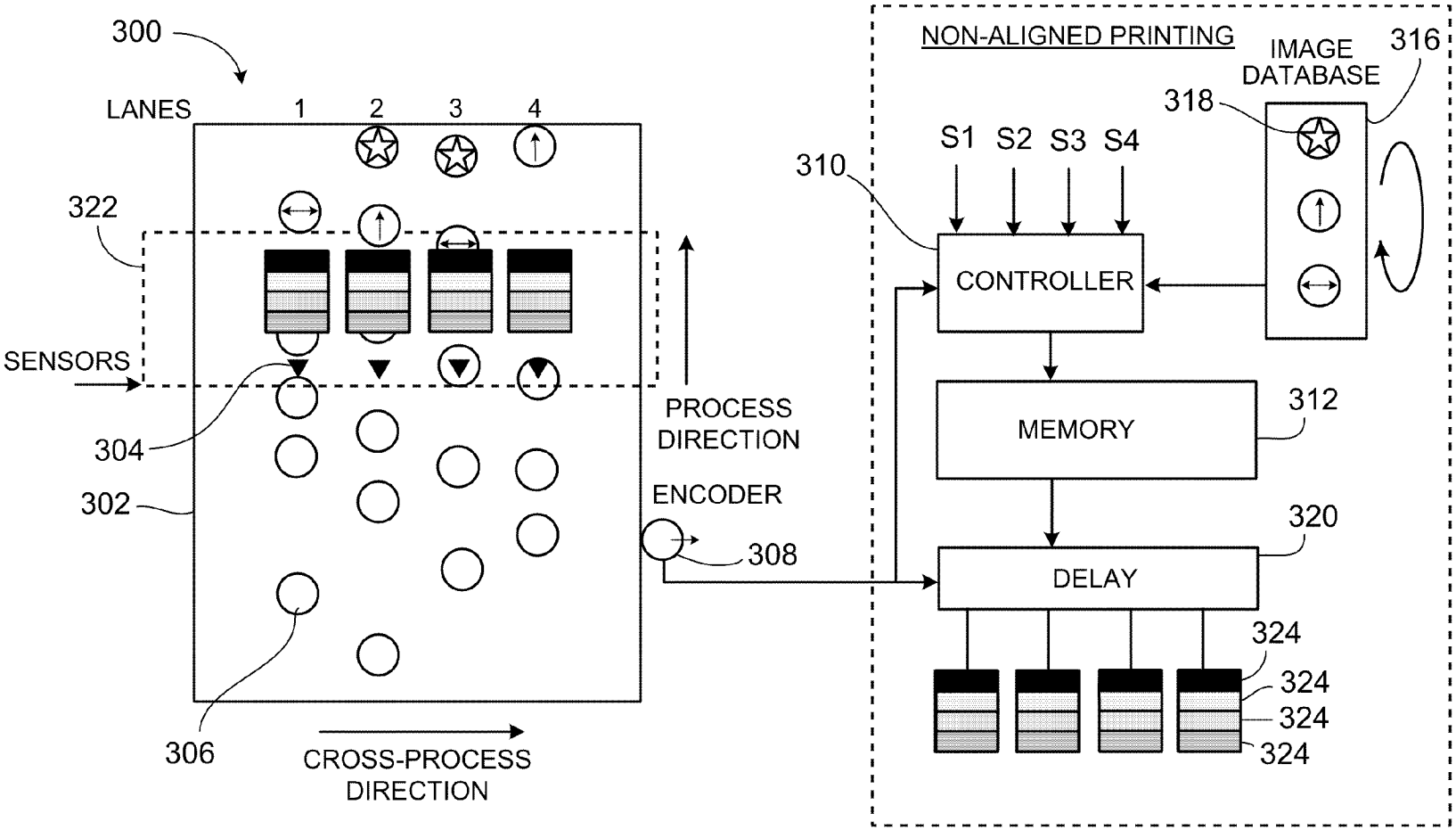
FIG. 3 is a schematic of a printing system with a plurality of lanes, a plurality of sensors, and a single controller.

Rather than a plurality of controllers, a single controller can be used by creating a virtual representation of the objects on the conveyor, as shown in the printing apparatus 300 of FIG. 3. A virtual representation can be created by tracking the movement of a conveyor 302 and using sensors 304 to detect the positions of a plurality of objects 306 on the moving conveyor. For example, an encoder 308 can generate and send timing signals to the single controller 310 representing the physical movement of a conveyor. Similarly, the sensors can send trigger signals to the controller when an object is detected. The controller uses the timing signals and trigger signals to create a virtual representation of the objects on the conveyor in the memory 312.

Figure 3A:
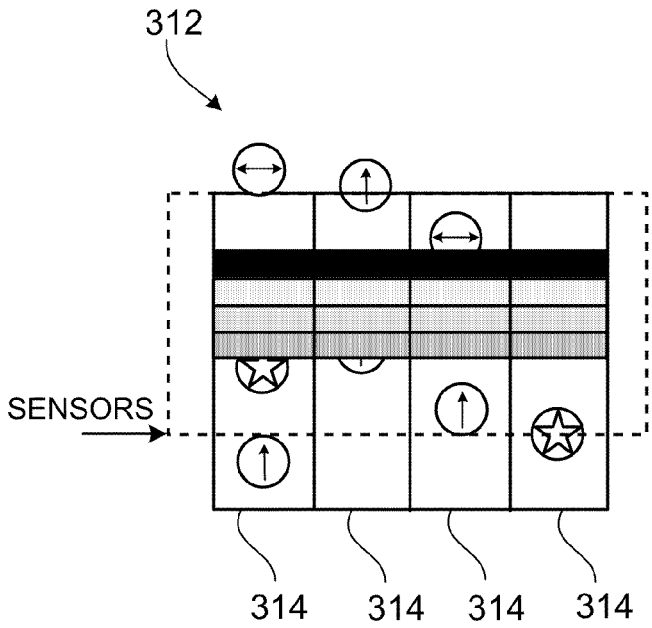
FIG. 3A is a schematic of a memory that receives print data from a controller.

The memory can be divided into a plurality of sections 314, such as four sections as shown in FIG. 3A, that correspond with the number of conveyor lanes. When the controller receives a signal from one of the sensors (e.g., S1, S2, S3, or S4), the controller determines which sensor sent the signal and adds image data to the section of the memory that corresponds to that particular lane.

The printing system can also include an image database 316 including one or more image data 318, three image data (star, arrow, and double-sided arrow) are shown in FIG. 3, that are rotated to provide variability to the printing process. A delay mechanism 320 can also be included to delay the drop ejection device 322 from depositing droplets until the object has traveled from the sensor to the drop ejection device. For example, the encoder can be used to transfer data from the memory to the drop ejection device through a delay mechanism. In the case of a plurality of modules 324 per lane, each color has a different delay constant. FIG. 3 shows four modules per lane, the first module can print cyan ink with a delay constant t, the second module can print magenta with a delay constant t+1, the third module can print yellow ink with a delay constant t+2, and the fourth module can print black with a delay constant of t+3.

Image data can be comprised of scan lines including binary data, 1s and 0s (1 is active, 0 is inactive), meaning the drop ejection device will deposit a fluid droplet where there is a 1 and not deposit a fluid droplet where there is a 0. Similarly, the memory can be comprised of 1s and 0s populated by the controller. The controller adds image data to the memory, for example, by using an "OR" function.

The "OR" function enables the drop ejection device to print complete images without interruption on objects that are next to each other with little or no gap between the objects. For example, two objects are next to each other on a conveyor such that they are touching as they traveling down the conveyor to a drop ejection device. A sensor detects the first object and sends a trigger signal to the controller. Soon after, the sensor detects the second object and sends another trigger signal to the controller. The controller adds a first image data to the memory using the "OR" function. Next, the controller adds the second image data to the memory using an "OR" function, such that if the first image data overlaps with the second image data, then the drop ejection device will print the 1s that are overlapped with 0s. The print data can be added one rasterized scan line at a time or the entire image could be copied into the memory.

Figure 3B:
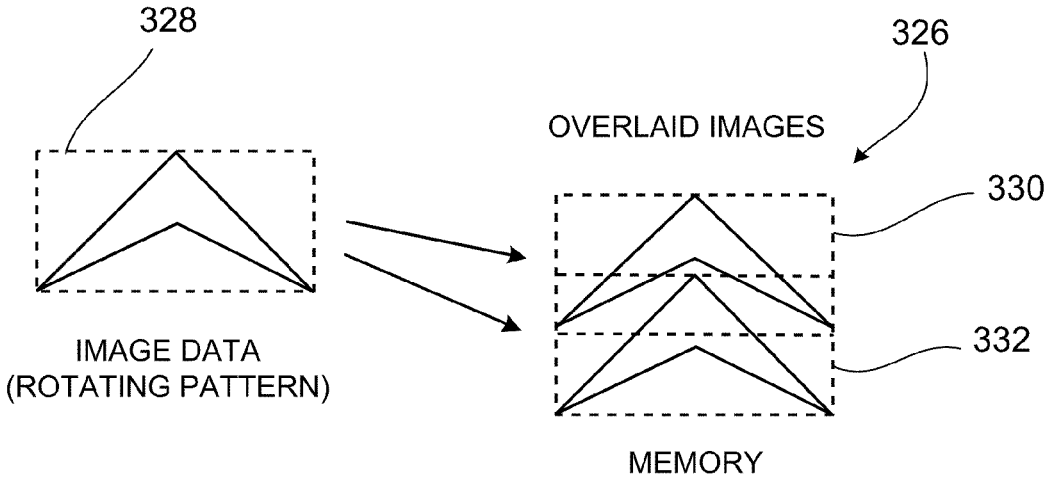
FIG. 3B is a schematic of two print data overlaid in the memory.

FIG. 3B shows a virtual representation 326 of two objects close together such that the arrow images 328 overlap. A bottom portion of the first image data 330 overlaps the top portion of the arrow in the second image data 332. The "OR" function combines the binary data of the two image data, and the memory enters a 1 if a 1 and 0 overlap. Thus, the bottom portion of the first image data will not block the top portion of the second image data, and the drop ejection will print both complete images on the corresponding first and second objects.

Figure 3C:
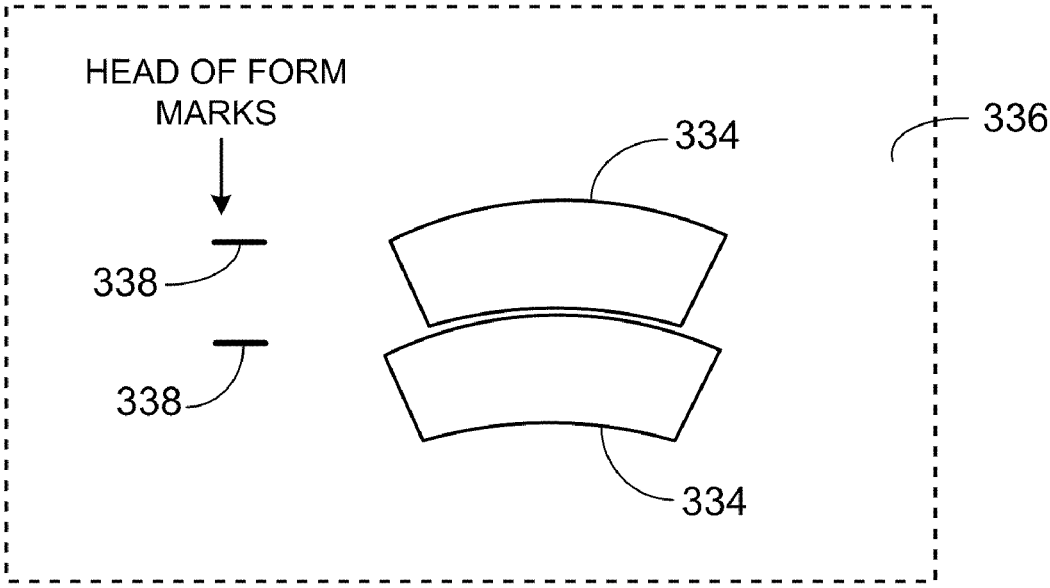
FIG. 3C is a schematic of a web having a plurality of marks that correspond to the locations of a plurality of objects on the web.

The "OR" function can also be used when printing on objects in which the image space of a neighboring object encroaches on another, such as paper cups 334 that have a tapered conical shape as shown in FIG. 3C. If the objects to be printed on are on a continuous web 336, then a mark 338 (e.g., head of forms mark) could be placed on the web next to the object to be printed on, and a sensor could detect this mark. The sensor sends a trigger signal to the controller, and the controller can use the "OR" function to overlay the images in the memory as described above.

Figure 4:
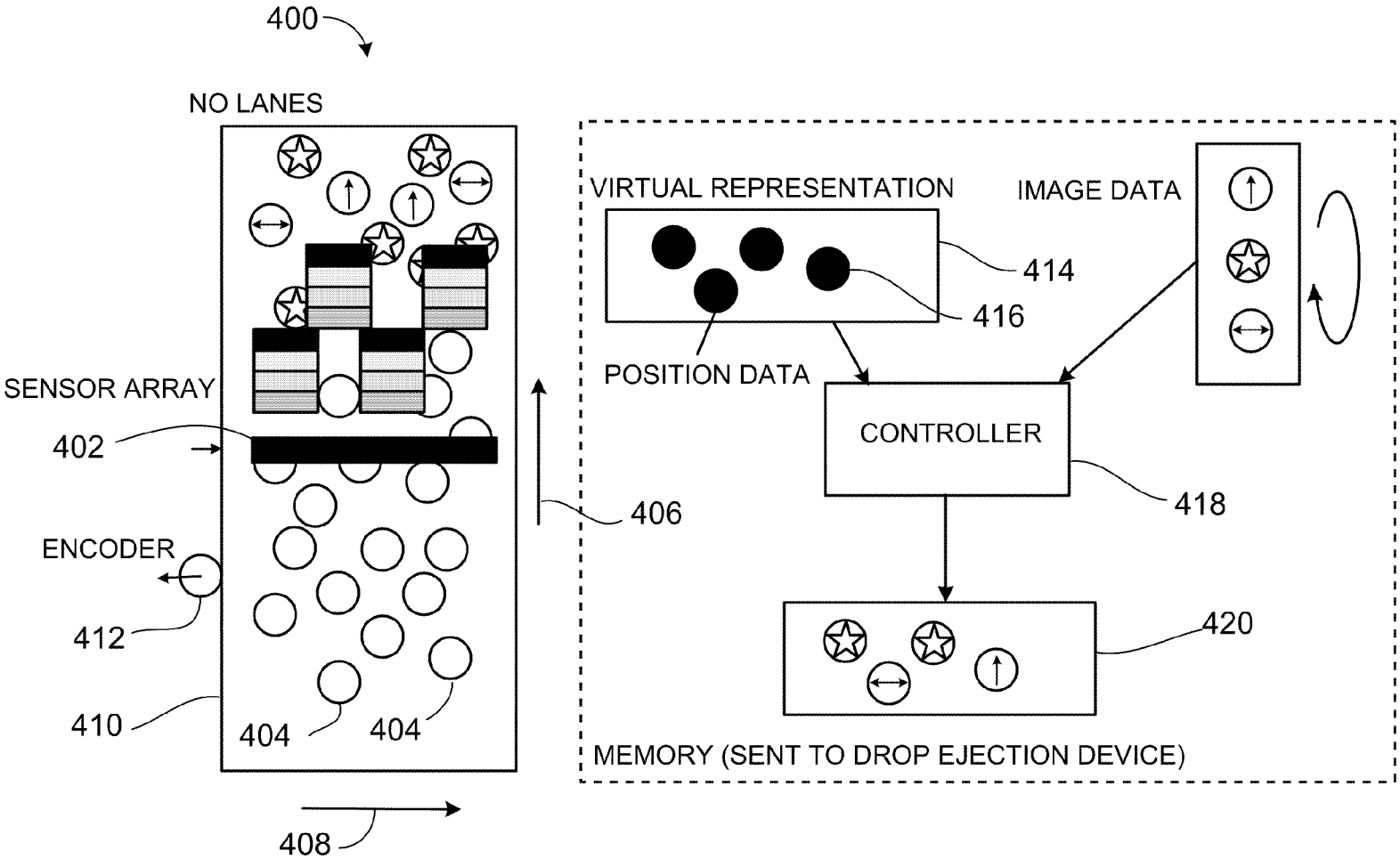
FIG. 4 is a schematic of a printing system with a conveyor and a sensor array.
Figures 5, 7A:
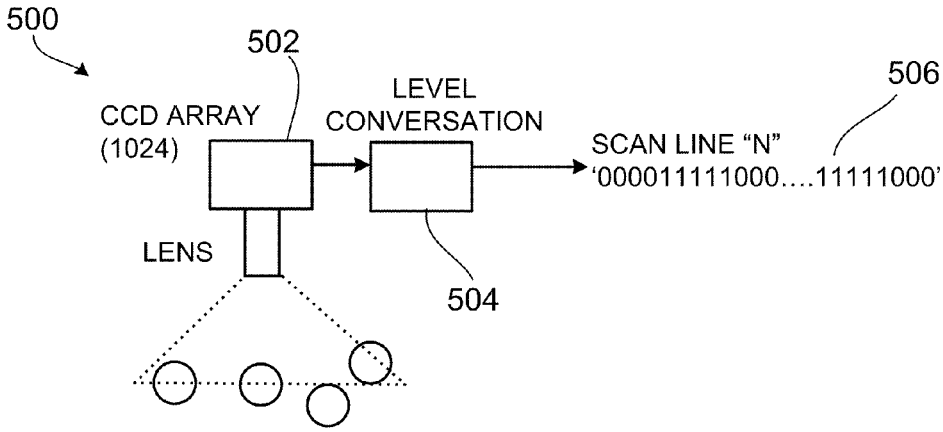
FIG. 5 is a schematic of a CCD array.
FIG. 7A is a schematic of the combination of binary data of the pattern data and the virtual image data Like reference symbols in the various drawings indicate like elements.

Rather than dividing a conveyor into separate lanes to align objects in the cross-process direction, a plurality of objects can be randomly placed on a conveyor so that they are neither aligned in the cross-process direction nor the process direction, as shown in the printing apparatus 400 of FIG. 4. A sensor array 402 can be used to detect the position of an object 404 in both the process direction 406 and cross-process direction 408. The sensor array can substantially span the width of the conveyor 410 in the cross-process direction, and the array can be stationary relative to the conveyor. If the sensor array substantially spans the conveyor and is positioned above the conveyor, the sensor array can detect more than one object at a time as shown in FIG. 4. The sensor array 500 can be a camera 502 (e.g., charge coupled device (CCD) camera), as shown in FIG. 5 and described later in this disclosure.

Referring back to FIG. 4, the encoder 412 and sensor array 402 can be used to create a virtual representation 414 of the objects moving on the conveyor. The encoder tracks the movement of the conveyor and the sensor array detects objects on the conveyor and sends position data 416 to the controller 418. The position data includes the position of the object on the conveyor in both the process direction and cross-process direction. The position data can be a single point (e.g., a leading edge) or a plurality of points representing the entire object. When the position data is a plurality of points, a program can analyze the position data to determine the center of the object. The controller then adds image data to the memory 420 in a space corresponding to the position data. Again the controller can use the "OR" function to add image data to the memory to overlay image data.

Figure 6:
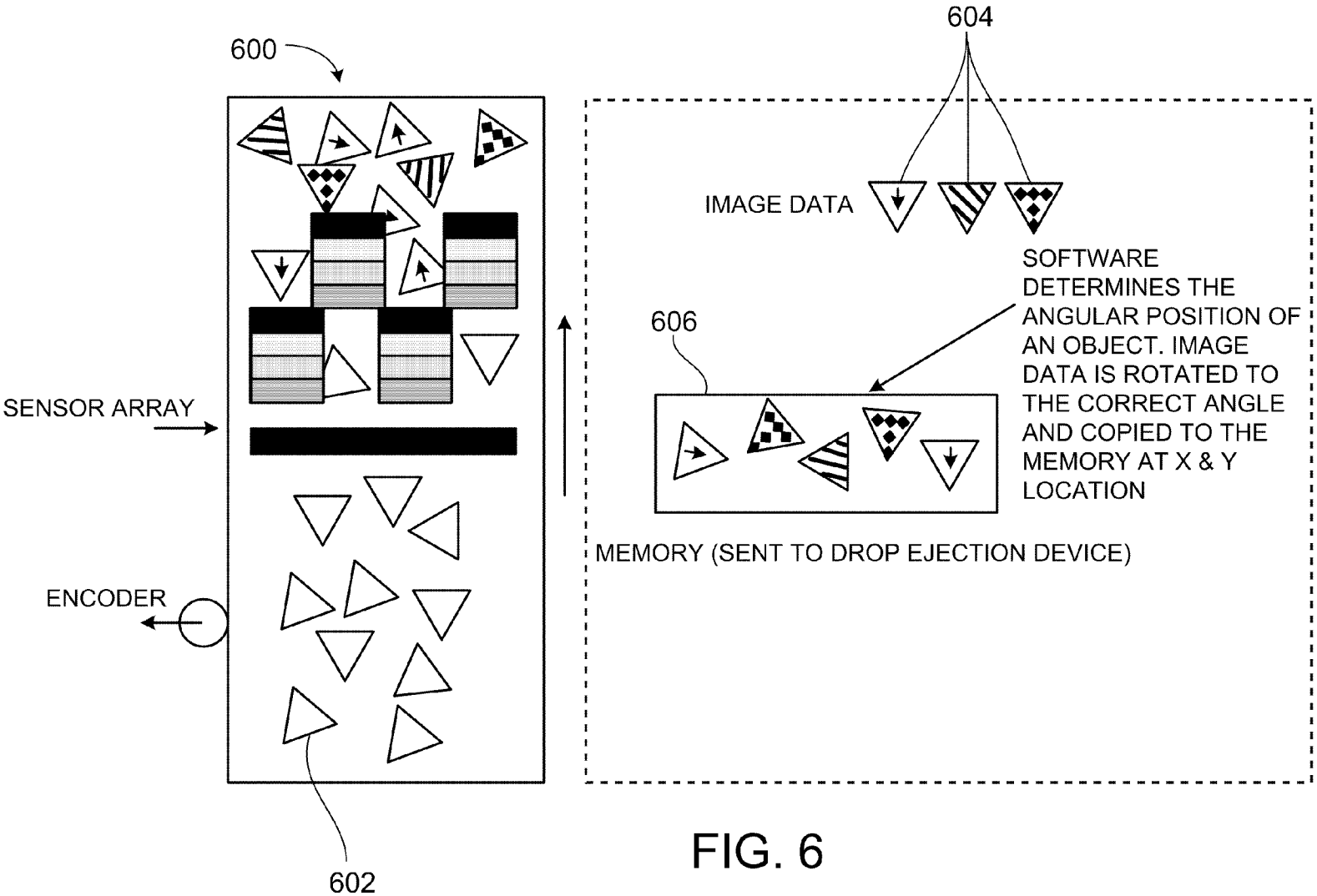
FIG. 6 is a schematic of a printing system including software to detect the angular position of an object.

FIG. 6 shows a printing system 600 that includes software to analyze the position data to identify an angular position of an object 602. The image data 604 can be rotated to match the angular position of the object, and the rotated image data is entered in the memory 606.

Figure 7:
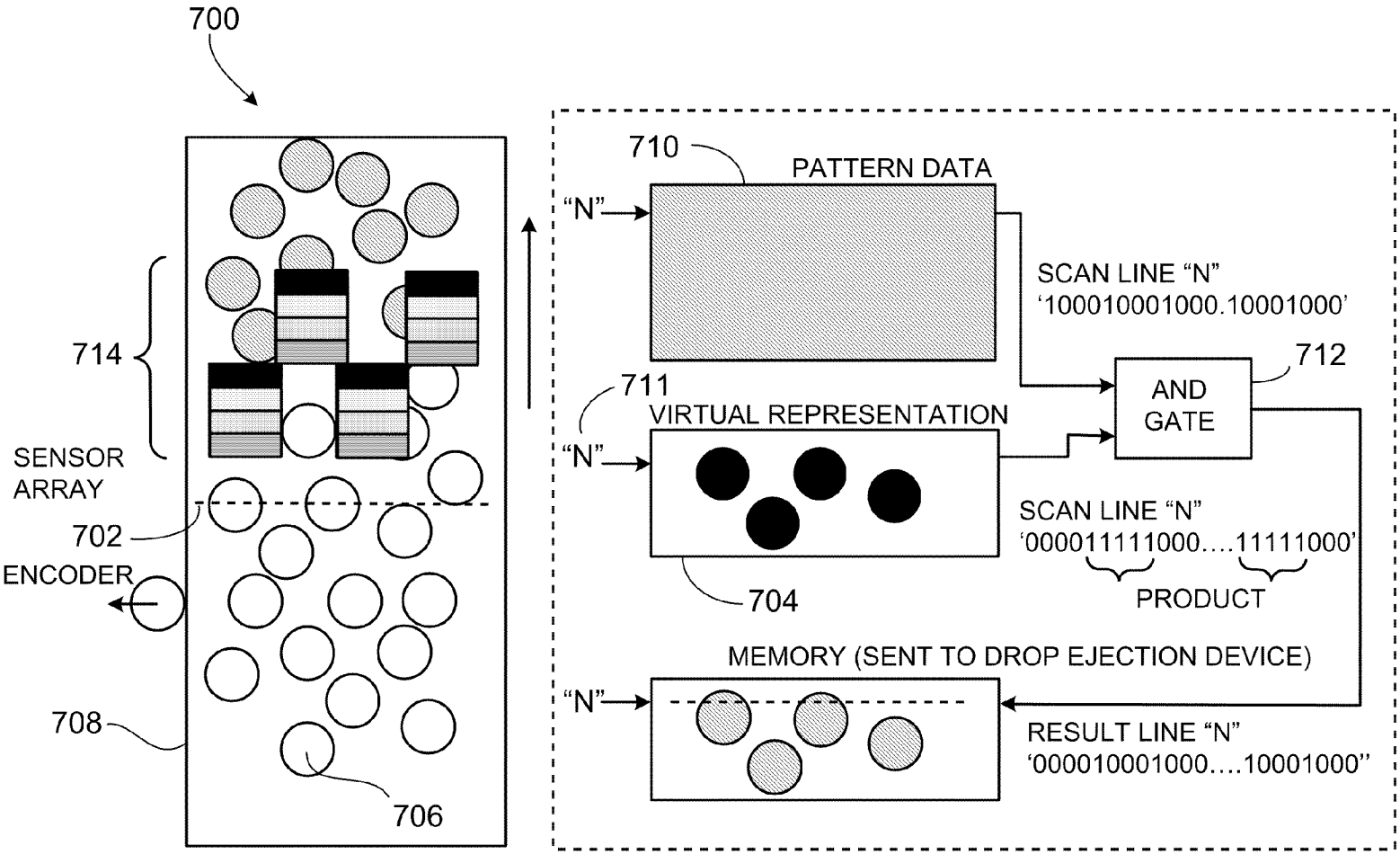
FIG. 7 is a schematic of a printing system including a conveyor and sensor array.

Instead of printing discrete images on individual objects, a pattern could be printed on an object as shown in the printing apparatus 700 of FIG. 7. As described above, the sensor 702 array can be used to create a virtual representation 704 of the objects 706 on a conveyor 708. The pattern data 710 comprised of scan lines N being combined with the scan lines N of the virtual image 711 using an "AND" gate 712. FIG. 7A shows the binary data of the pattern scan line 716 and virtual image scan line 718 being combined using the "AND" function. The drop ejection device 714 will only print when both the pattern data scan line and the virtual image scan line are high (1=active).

If either of the scan lines are low (0=inactive), then the result line 720 "N" is low and the drop ejection device will not deposit a droplet. If the pattern data is repeatable, the data can be restarted at scan line 1 to produce a continuously repeating image pattern.

Referring back to FIG. 5, the sensor array described in FIGS. 4, 6, and 7 can include a camera 502, such as a CCD camera. The sensor array 500 can have a resolution similar to the resolution of the drop ejection device. For example, the drop ejection device can include four modules that substantially span the width of the conveyor, each module has 256 jets for a total of (4×256) 1024 jets and the total width of the modules is about 10 inches. Therefore, to match the printing resolution of the drop ejection device, the sensor array needs a resolution of about 100 dpi (1024 jets/10 inches). For example, a CCD camera as shown in FIG. 5 can have a plurality of elements (e.g., 1000 or more, such as 1024) and optics can be used to focus the width of the products to achieve a particular resolution (e.g., 100 dpi or more, 200 dpi or more, or 300 dpi or more). A level conversion 504 can be used to change gray scale camera data into binary data 506.

A number of embodiments of the invention have been described. Nevertheless, it will be understood that various modifications may be made without departing from the spirit and scope of the invention. Accordingly, other embodiments are within the scope of the following claims.

All references described herein are incorporated by reference for all purposes.

What is claimed is:

1. An printing apparatus comprising, a conveyor capable of moving a plurality of objects in a process direction, the plurality of objects placed on the conveyor being neither aligned in the process direction nor a cross-process direction that is perpendicular to the process direction;

a drop ejection device;

a sensor array that substantially spans the conveyor in the cross-process direction and is configured to detect more than one object at a time and to detect a position of each object in the process direction and the cross-process direction; and a controller configured to receive position data about the plurality of objects from the sensor array and to cause the drop ejection device to deposit fluid droplets on the plurality of objects based on the positions of the plurality of objects on the conveyor.

2. The apparatus of claim 1, wherein the sensor array is configured to detect a leading edge of each object.

3. The apparatus of claim 1, wherein the controller is configured to cause the drop ejection device to deposit fluid droplets on more than one object at a time.

4. The apparatus of claim 1, wherein the sensor array is a charge coupled device camera.

5. The apparatus of claim 1, wherein the sensor array has a resolution that matches a resolution of the drop ejection device. of each object.

6. The apparatus of claim 1, wherein a resolution of the drop ejection device is 100 dpi.

7. The apparatus of claim 1, wherein the sensor array is stationary relative to the conveyor.

8. The apparatus of claim 1, wherein the drop ejection device is stationary relative to the conveyor.

9. The apparatus of claim 1, wherein the controller is configured to combine the position data with image data to create print data that is sent to the drop ejection device.

10. The apparatus of claim 9, wherein the position data and image data comprise a plurality of scan lines comprising binary data including 1s and 0s, 1 for active and 0 For inactive, and the controller configured to combine the position data and image data using an AND function.

11. The apparatus of claim 9, further comprising an image database for storing at least one image data that is sent to the controller.

12. The apparatus of claim 9, wherein the controller comprises software configured to determine an angle of each object and to adjust the image data to correspond to the angle of each object.

13. The apparatus of claim 9, further comprising a memory that receives the print data from the controller and sends the print data to the drop ejection device.

14. The apparatus of claim 13, wherein the controller comprises software configured to determine a center of each object based on the position data and to add the print data to the memory based on the center of each object.

15. The apparatus of claim 13, wherein the controller is configured to add image data to the memory to overlay the image data in a space corresponding to the position data using an "OR" function.

16. The apparatus of claim 1, further comprising a delay mechanism that delays the drop ejection device from depositing fluid droplets on each object until that object has traveled from the sensor to the drop ejection device.

17. The apparatus of claim 16, wherein the drop ejection device comprises a plurality of jetting arrays.

18. The apparatus of claim 17, wherein each jetting array comprises a plurality of modules, each module configured to deposit a different color ink.

19. The apparatus of claim 18, wherein the delay mechanism delays the drop ejection device from depositing ink from each module on each object until that object has have reached that module.

20. A method comprising:

moving a plurality of objects on a conveyor in a process direction;

detecting positions of at least two objects at a time in the process direction and a cross-process direction, which is perpendicular to the process direction, using a sensor array that substantially spans the conveyor in the cross-process direction;

sending position data to a controller; and causing a drop ejection device to deposit fluid droplets on the at least two objects based on the positions of the at least two objects on the conveyor.

21. The method of claim 20, further comprising delaying the drop ejection device from depositing droplets on each object until that objects has reached the drop ejection device.

22. The method of claim 20, wherein the sensor array is stationary relative to the conveyor.

23. The method of claim 20, wherein the drop ejection device is stationary relative to the conveyor.

24. The method of claim 20, further comprising adding image data to a memory to overlay the image data in a space corresponding to the position data using an "OR" function.

25. The method of claim 20, wherein the positions of the at least two objects are detected by a charge coupled device camera.

26. The method of claim 25, further comprising matching a resolution of the camera to a resolution of the drop ejection device.

27. The method of claim 20, further comprising combining the position data with image data to create print data, and sending the print data to the drop ejection device.

28. The method of claim 27, further comprising sending the print data to a memory before sending the print data to the drop ejection device.

* * * * *

UNITED STATES PATENT AND TRADEMARK OFFICE

CERTIFICATE OF CORRECTION

PATENT NO. : 8,025,354 B2
APPLICATION NO. : 12/478678
DATED : September 27, 2011
INVENTOR(S) : Richard J. Baker It is certified that error appears in the above-identified patent and that said Letters Patent is hereby corrected as shown below:

Column 6; line 61:

After "device." delete "of each object".

Column 7; line 6:

Change "For" to --for--.

Column 7; line 37:

After "has" delete "have".

Column 8; line 15:

Change "objects" to --object--.

Signed and Sealed this
Fifteenth Day of November, 2011

David J. Kappos

David J. Kappos
*Director of the United States Patent and Trademark Office*